US006945808B1

(12) United States Patent
Hisamatsu

(10) Patent No.: US 6,945,808 B1
(45) Date of Patent: Sep. 20, 2005

(54) CONNECTOR IN WHICH A LOCKING MECHANISM IS PROTECTED

(75) Inventor: Kazuhito Hisamatsu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/856,438

(22) Filed: May 28, 2004

(30) Foreign Application Priority Data

Mar. 17, 2004 (JP) ..... 2004/076749

(51) Int. Cl.[7] ..... H01R 13/627
(52) U.S. Cl. ..... 439/358
(58) Field of Search ..... 439/358, 357, 439/350

(56) References Cited

U.S. PATENT DOCUMENTS 5,332,330 A * 7/1994 Kaneko ..... 403/321
5,741,150 A * 4/1998 Stinson et al. ..... 439/358

FOREIGN PATENT DOCUMENTS

| | | |
|---|---|---|
| JP | 01132073 | 5/1989 |
| JP | 511362 | 2/1993 |
| JP | 2002/367725 | 12/2002 |
| WO | WO9824152 | 6/1998 |

* cited by examiner

*Primary Examiner*—Phuong Dinh
(74) *Attorney, Agent, or Firm*—Collard & Roe, P.C.

(57) ABSTRACT

In a connector in which an insulator holds a conductive contact to be connected to a mating connector, the insulator has a receiving portion receiving a locking mechanism for locking a state of connection with the mating connector. The locking mechanism has a main body, a locking portion extending from the main body, a spring portion urging the locking portion, and an operating portion for unlocking the locking portion. The receiving portion has a cover part covering the spring portion and the operating portion.

2 Claims, 5 Drawing Sheets

CONNECTOR IN WHICH A LOCKING MECHANISM IS PROTECTED

This application claims priority to prior Japanese patent application JP 2004-76749, the disclosure of which is incorporated herein by reference.

BACKGROUND OF THE INVENTION

This invention relates to a connector having a locking mechanism for locking connection with a mating connector when the connector is connected to the mating connector.

For example, Japanese Patent Application Publication (JP-A) No. 2002-367725 discloses a locking device in a connector of the type. The locking device has a lock spring member received in a lock spring receiving portion formed in a cover insulator of the connector. The lock spring member has an engaging portion extending out of the cover insulator to be engaged with a mating connector, and a spring portion urging the engaging portion so as to engage the engaging portion with the mating connector.

In the locking device mentioned above, the lock spring member is partly exposed out of the cover insulator. If an exposed part of the lock spring member is increased, the locking device may cause an operation error or may become unable to be connected with the mating connector under an external force acting upon the exposed part. Further, it is difficult to improve an operability because an area contributing to an operation of the lock spring member is small.

SUMMARY OF THE INVENTION

It is therefore an object of the present invention to provide a connector having a locking mechanism which hardly causes an operation error and easily achieves an improvement in operability.

Other objects of the present invention will become clear as the description proceeds.

According to an aspect of the present invention, there is provided a connector comprising a conductive contact to be connected to a mating connector, an insulator holding the conductive contact and having a receiving portion, and a locking mechanism received in the receiving portion for locking a state of connection with the mating connector, the locking mechanism comprising a main body, a locking portion extending from one end of the main body, a spring portion extending from the other end of the main body and continuously urging the locking portion in an engaging direction towards engagement with the mating connector, and an operating portion extending in a direction parallel to the spring portion for unlocking the locking portion, the receiving portion having a cover portion at least partially covering the spring portion and the operating portion.

DESCRIPTION OF THE PREFERRED EMBODIMENT

Figure 1:
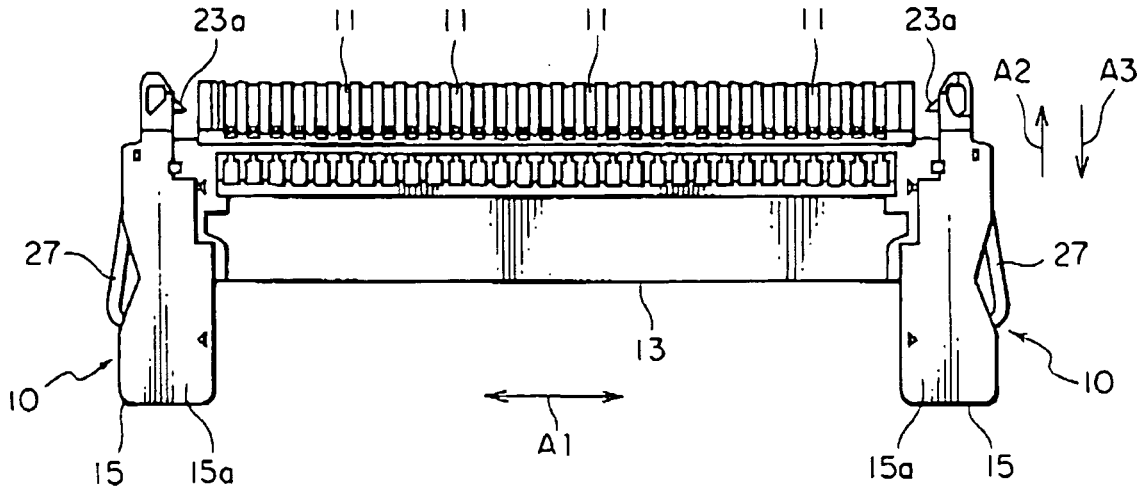
FIG. 1 is a plan view of a connector according to an embodiment of the present invention.

Referring to FIG. 1, description will be made of a whole of a connector according to an embodiment of the present invention.

The connector illustrated in the figure comprises a plurality of conductive contacts 11, an insulator 13 holding the contacts 11, and a pair of locking mechanisms 10 disposed on opposite sides of the insulator 13 in a longitudinal direction A1. The contacts 11 are arranged in parallel to one another at a predetermined interval in the longitudinal direction A1 of the insulator 13. The insulator 13 has a pair of receiving portions 15 integrally formed on the opposite sides in the longitudinal direction A1. Each of the locking mechanisms 10 is received in each of the receiving portions 15 and serves to lock a connected state between the connector and a mating connector (not shown). FIG. 1 shows a locked state where a locking operation is carried out by the locking mechanisms 10.

Figure 2:
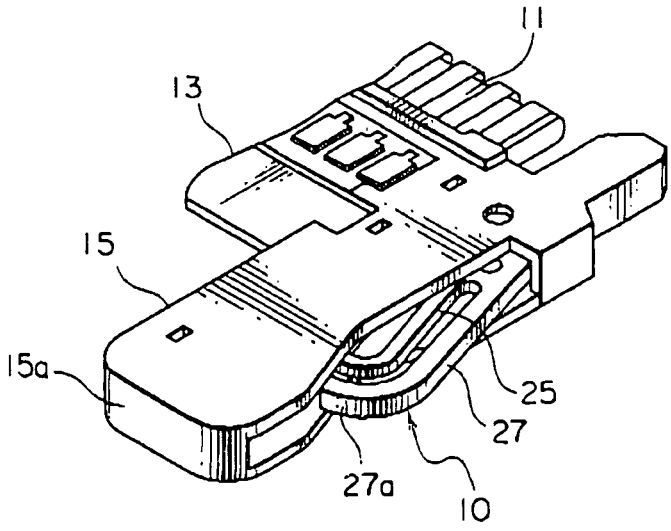
FIG. 2 is an enlarged perspective view of a characteristic part of the connector illustrated in FIG. 1.
Figure 3:
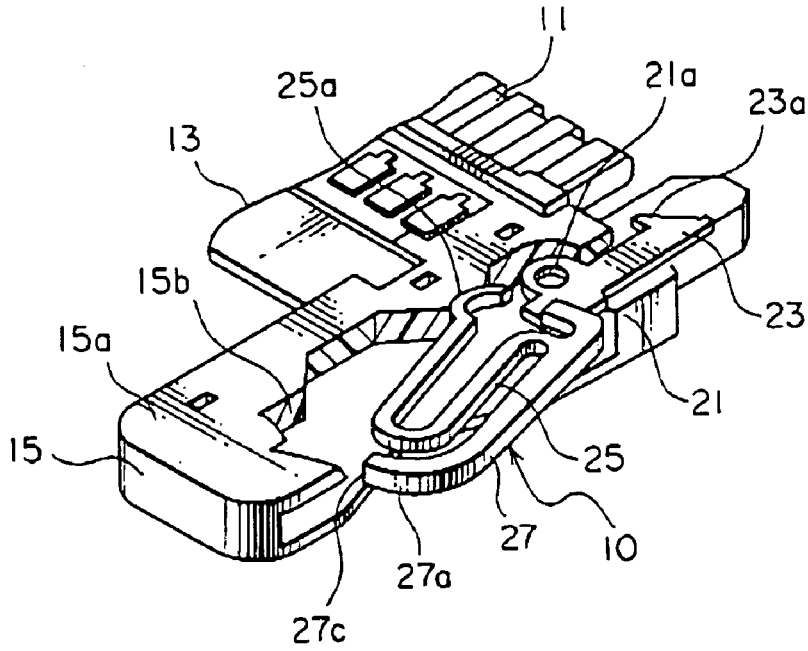
FIG. 3 is an enlarged perspective view similar to FIG. 2, with a part cut away to show a locking mechanism.
Figure 4:
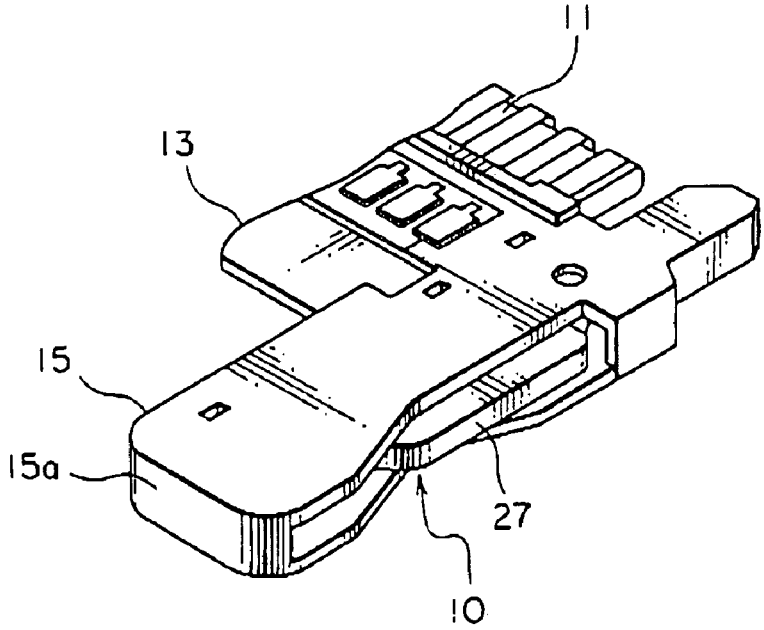
FIG. 4 is an enlarged perspective view similar to FIG. 2 in a state where the locking mechanism is operated.
Figure 5:
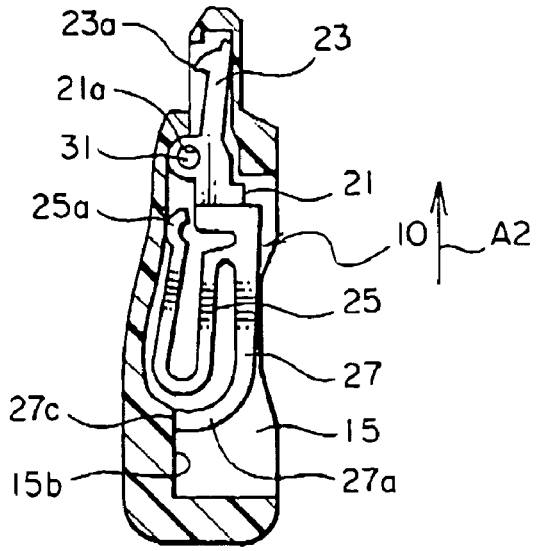
FIG. 5 is a sectional plan view showing the state where the locking mechanism is operated.

Referring to FIGS. 2 through 5 in addition, each of the locking mechanisms 10 will be described. FIGS. 2 and 3 show the locked state where the locking operation is carried out while FIGS. 4 and 5 show an unlocked state where an unlocking operation is carried out.

Each of the locking mechanisms 10 comprises a main body 21, a locking portion 23 extending from one end of the main body 21, a spring portion 25 extending from the other end of the main body 21 and continuously urging the locking portion 23 in an engaging direction towards engagement with a mating connector (not shown) to return the locking portion 23 to a normal position after the unlocking operation is carried out, and an operating portion 27 extending in a direction parallel to the spring portion 25 to make the locking portion 23 engage and disengage the mating connector.

A combination of the locking portion 23, the spring portion 25, and the operating portion 27 forms a lock lever. The locking portion 23 has a hook part 23*a* formed at its end. The hook part 23*a* is adapted to be engaged with a mating engaging portion (not shown) of the mating connector when the connector is fitted to the mating connector.

The operating portion 27 has a free end 27*a* curved along a U-shaped part of the spring portion 25. Irrespective of the locked state or the unlocked state, the free end 27*a* of the operating portion 27 is covered with the receiving portion 15 without being exposed.

The spring portion 25 has a generally U-shaped profile and has one end connected to the main body 21. The spring portion 25 serves to smoothen an operation of the operating portion 27. Since the spring portion 25 is covered with the receiving portion 15, it is protected from a load acting in a connecting direction (fitting direction) A2 or an anti-connecting direction A3.

In the state illustrated in FIG. 5, the locking portion 23 is also covered with the receiving portion 15 in the connecting direction A2. Therefore, if the state in FIG. 5 is achieved when the connector in FIG. 1 is fitted to the mating connector, the locking portion 23 is not directly touched. The spring portion 25 has a free end 25*a* which is kept in contact with a wall surface of the receiving portion 15 and which serves to prevent deformation of the spring portion 25 due to excessive displacement.

The insulator 13 is shaped so that the insulator 13 covers the operating portion 27 in three directions, i.e., upward and downward directions (perpendicular to a drawing sheet in FIG. 1) and the connecting direction A2, and protects the operating portion 27 from an external force exerted in any direction except an operating direction, namely, the longitudinal direction A1. The receiving portion 15 has a cover part 15*a* at least partially covering the spring portion 25 and the operating portion 27, and a contacting part 15*b* as a wall surface of the insulator 13. The free end 27*a* of the operating portion 27 has a terminal end as a contacted part 27 to be brought into contact with the contacting part 15*b* when the operating portion 27 is operated.

The locking mechanism 10 further has a rotation shaft 31 formed in the receiving portion 15, and a hole-like shaft portion 21*a* formed in the main body 21 so as to be engaged with the rotation shaft 31. By receiving the locking mechanism 10 in the receiving portion 15, the rotation shaft 31 is engaged with the shaft portion 21*a* so that the locking mechanism 10 is rotatably held by the insulator 13.

In the state illustrated in FIGS. 1 through 3, a part of the operating portion 27 protrudes out of the cover portion 15*a*. When the operating portion 27 is forced into an inside of the cover portion 15*a*, the state illustrated in FIGS. 4 and 5 is obtained. Then, the locked state is released or cancelled.

Figure 6:
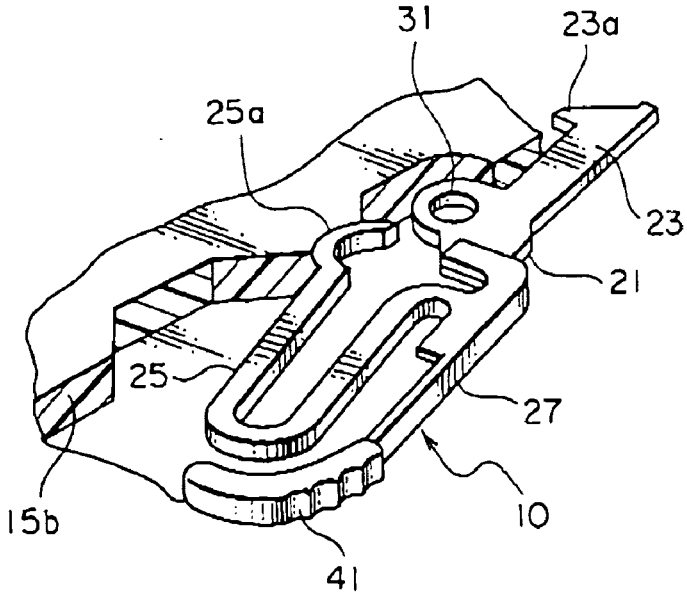
FIG. 6 is a perspective view showing a first modification of the locking mechanism.

FIG. 6 shows a first modification of the locking mechanism 10. In the locking mechanism 10 illustrated in FIG. 6, the free end 27*a* of the operating portion 27 is covered with a resin member 41. The resin member 41 may be formed as a heat shrinkable tube fitted over the free end 27*a*.

Figure 7:
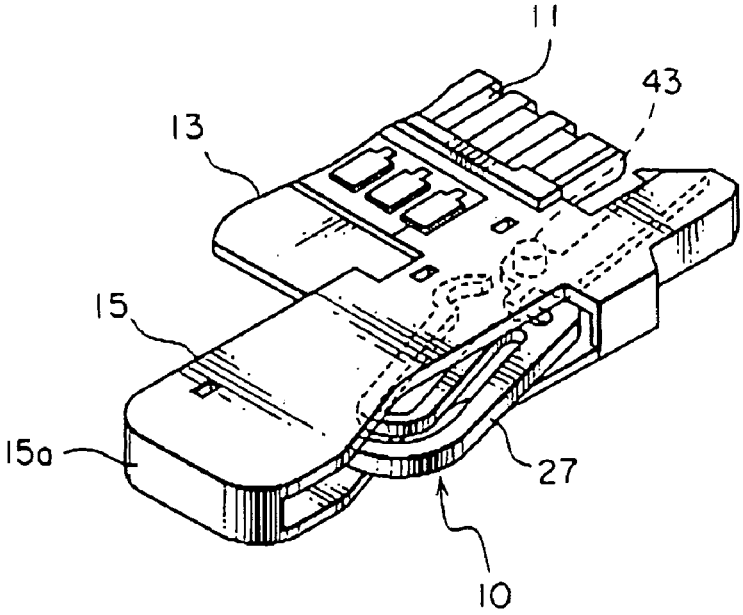
FIG. 7 is a perspective view showing a second modification of the locking mechanism.

FIG. 7 shows a second modification of the locking mechanism 10. In the locking mechanism 10 illustrated in FIG. 7, the main body 21 is provided with a rotation shaft 43 while the insulator 13 is provided with a hole-like shaft portion engaged with the rotation shaft 43. In this case, the rotation shaft 43 is engaged with the shaft portion so that the locking portion 23 is rotatable.

Figure 8:
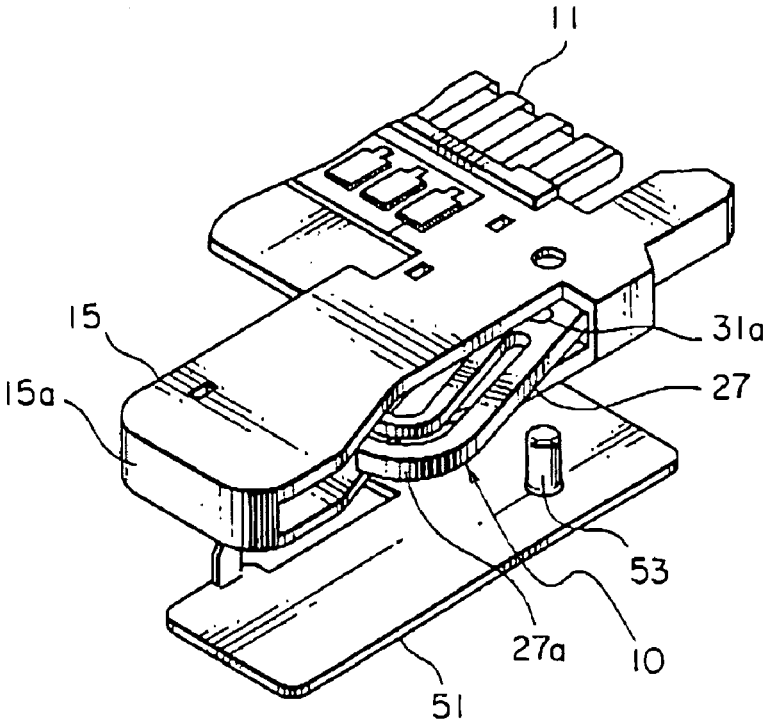
FIG. 8 is a perspective view showing a third modification of the locking mechanism.
Figure 9:
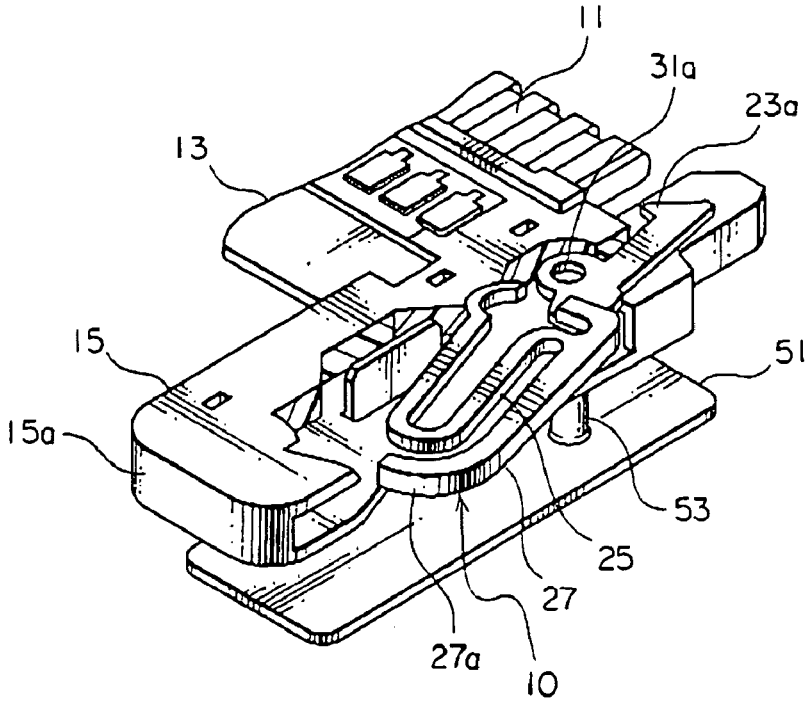
FIG. 9 is a perspective view similar to FIG. 8, with a part cut away to show the locking mechanism.

FIGS. 8 and 9 shows a third modification of the locking mechanism 10. In this case, the connector further has a conductive shell (for example, a metal shell) 51 for ground connection. The shell 51 is provided with a rotation shaft 53 while the main body 21 is provided with a hole-like shaft portion 31*a* engaged with the rotation shaft 53.

With the above-mentioned structure, when the shell 51 is coupled with the receiving portion 15, the rotation shaft 53 and the shaft portion 31*a* are engaged with each other so that the locking mechanism 10 is rotatably held by the insulator 13.

Figure 10:
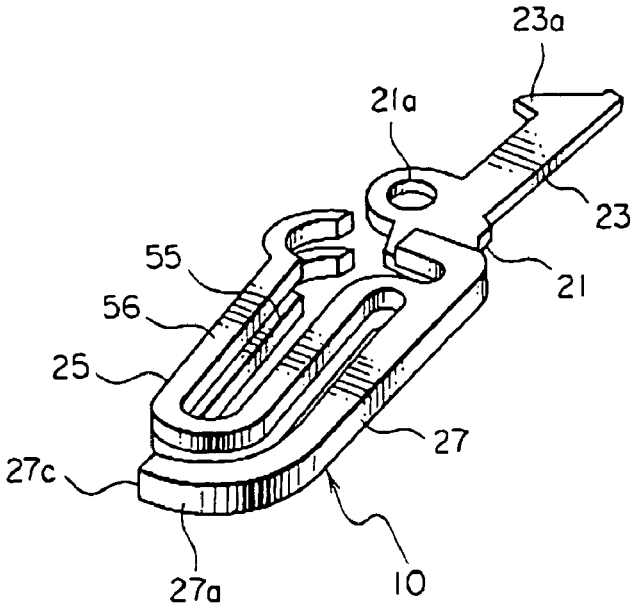
FIG. 10 is a perspective view showing a fourth modification of the locking mechanism.

FIG. 10 shows a fourth modification of the locking mechanism 10. In the locking mechanism 10 in FIG. 10, a pair of spring portions 55 and 56 are connected to the main body 21. The spring portions 55 and 56 are faced to each other with a space left therebetween.

Each of the various connectors mentioned above is suitable for use in an electronic or an electric apparatus required to be locked in a state where a mating connector and a cable are connected to the connector.

While the present invention has thus far been described in conjunction with the preferred embodiments thereof, it will be readily possible for those skilled in the art to put this invention into practice in various other manners without departing from the scope of this invention. Although description is made as regards connectors of a particular type, it is a matter of course that the present invention can be applied to a connector of another type.

What is claimed is:

1. A connector comprising:

a conductive contact to be connected to a mating connector;

an insulator holding said conductive contact and having a receiving portion;

a conductive shell; and a locking mechanism received in said receiving portion for locking a state of connection with said mating connector, said locking mechanism comprising:

a main body;

a locking portion extending from one end of said main body;

a spring portion extending from the other end of said main body and continuously urging said locking portion in an engaging direction towards engagement with said mating connector;

an operating portion extending in a direction parallel to said spring portion for unlocking said locking portion, said receiving portion having a cover portion at least partially covering said spring portion and said operating portion;

a rotation shaft formed on said shell; and a shaft receiving portion formed in said main body to be engaged with said rotation shaft, said rotation shaft and said shaft receiving portion being engaged with each other when said shell is coupled with said insulator, said locking mechanism being rotatable held by said insulator.

2. The connector according to claim 1, wherein said receiving portion has a contacting portion, said operating portion having a contacted portion to be contacted with said contacting portion when said operating portion is operated.

* * * * *